United States Patent [19]

Cannady

[11] Patent Number: 4,958,392

[45] Date of Patent: Sep. 25, 1990

[54] COMBINATION RECLINING HEADBOARD AND TABLE FOR A BED

[76] Inventor: Charles L. Cannady, 38 Stokes Rd., Pineville, La. 71360

[21] Appl. No.: 519,799

[22] Filed: May 7, 1990

[51] Int. Cl.[5] ..... A47C 20/04

[52] U.S. Cl. ..... 5/507; 5/53.2

[58] Field of Search ..... 5/53 R, 53 B, 507, 433, 5/53 C, 53 D; D6/505, 506

[56] References Cited

U.S. PATENT DOCUMENTS 2,724,127 11/1955 Trivas et al. ..... 5/53.1
3,351,960 11/1967 Burkholder ..... 5/53.1
4,651,365 3/1987 Zeigler ..... 5/433

FOREIGN PATENT DOCUMENTS 622986 5/1949 United Kingdom ..... 5/53.1

*Primary Examiner*—Alexander Grosz
*Attorney, Agent, or Firm*—Michael I. Kroll

[57] ABSTRACT

A combination reclining headboard and table for a bed is provided and consists of four head posts, spaced apart and secured to the head of the bed frame, thus dividing it into three sections. A pair of headboard panels are each sized to fit between two of the head posts at the first and third sections, while a table panel is sized to fit between two of the head posts at the second section. Each of the headboard panels adjustably moves from a vertical position to a rearwardly reclined position so that a person can rest against it. The table panel adjustably moves from a vertical position to a forward horizontal position so that a person can place various items on it.

7 Claims, 2 Drawing Sheets

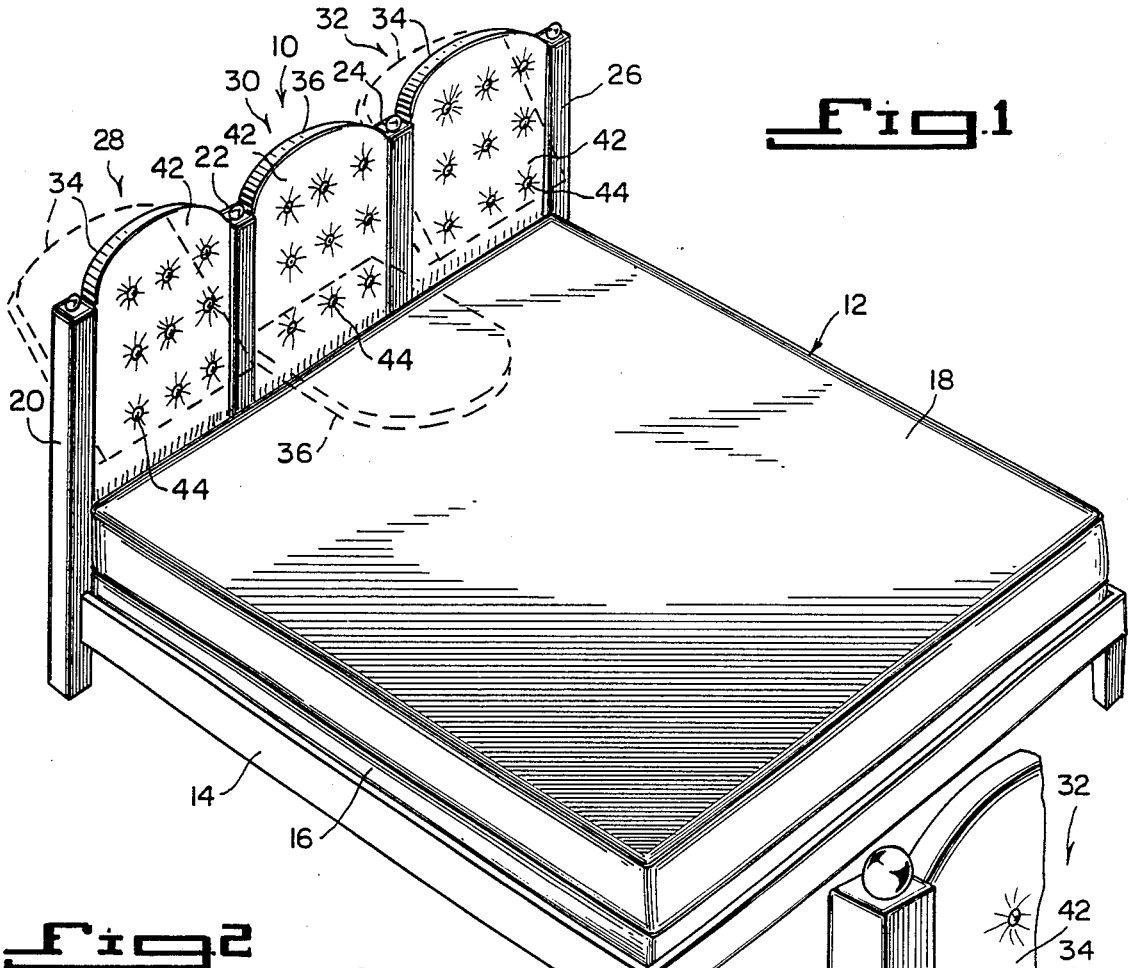
Fig.1
Fig2
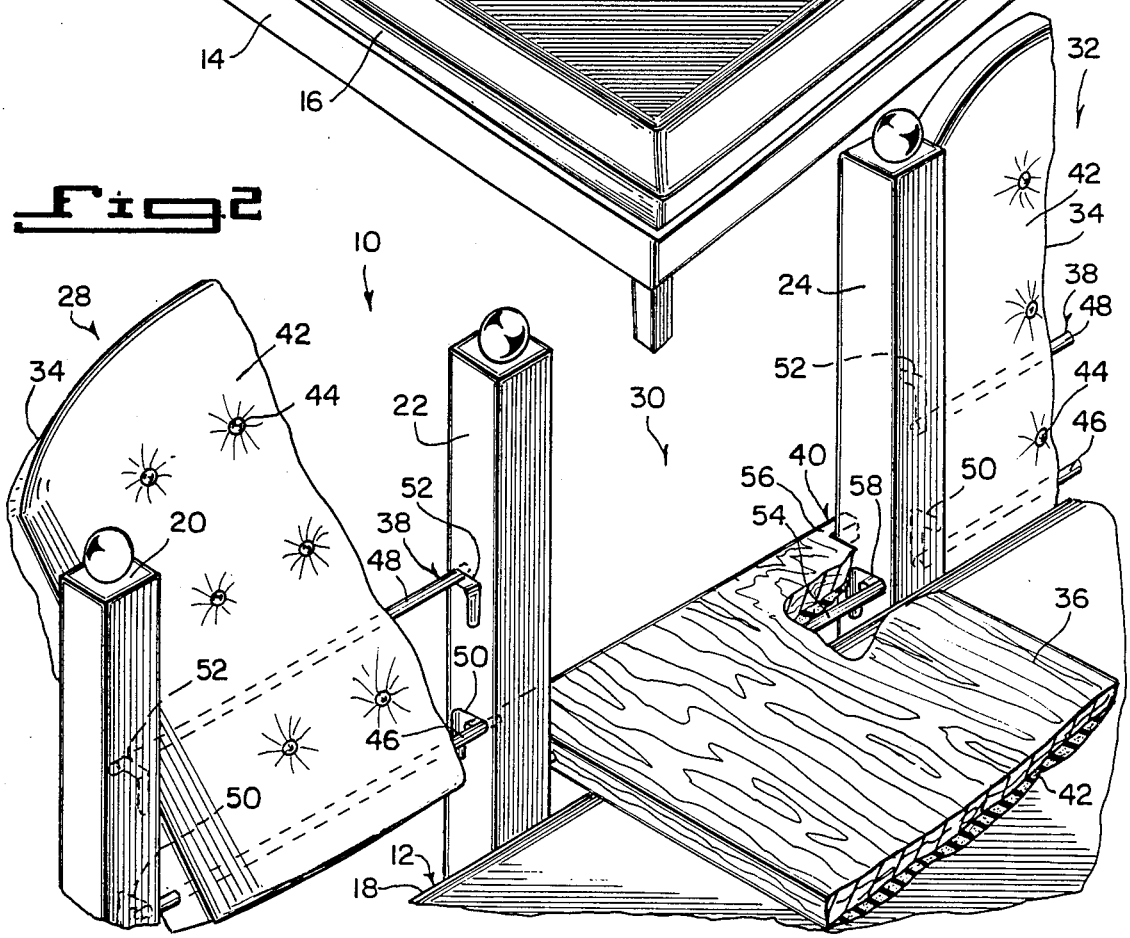

COMBINATION RECLINING HEADBOARD AND TABLE FOR A BED

BACKGROUND OF THE INVENTION

1. Field of the Invention

The instant invention relates generally to beds and more specifically it relates to a combination reclining headboard and table for a bed.

2. Description of the Prior Art

Numerous beds have been provided in prior art that are adapted to include headboards which are stationary panels that form the heads of the beds. Since they are stationary panels, they cannot be adjusted to accommodate various positions for people using the beds. While these units may be suitable for the particular purpose to which they address, they would not be as suitable for the purposes of the present invention as heretofore described.

SUMMARY OF THE INVENTION

A primary object of the present invention is to provide a combination reclining headboard and table for a bed that will overcome the shortcomings of the prior art devices.

Another object is to provide a combination reclining headboard and table for a bed in which two people can each comfortably rest against one of two adustable rearwardly reclining headboard panels with an adjustable forwardly horizontal table panel therebetween.

An additional object is to provide a combination reclining headboard and table for a bed in which the two adjustable rearwardly reclining headboard panels can be manually operated or power operated controlled.

A further object is to provide a combination reclining headboard and table for a bed that is simple and easy to use.

A still further object is to provide a combination reclining headboard and table for a bed that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a front perspective view of the instant invention installed on a bed.

FIG. 2 is an enlarged front perspective view of the instant invention with parts broken away.

DETAILED DESCRIPTION OF THE PREFERRED EMBODIMENTS

Figure 4:
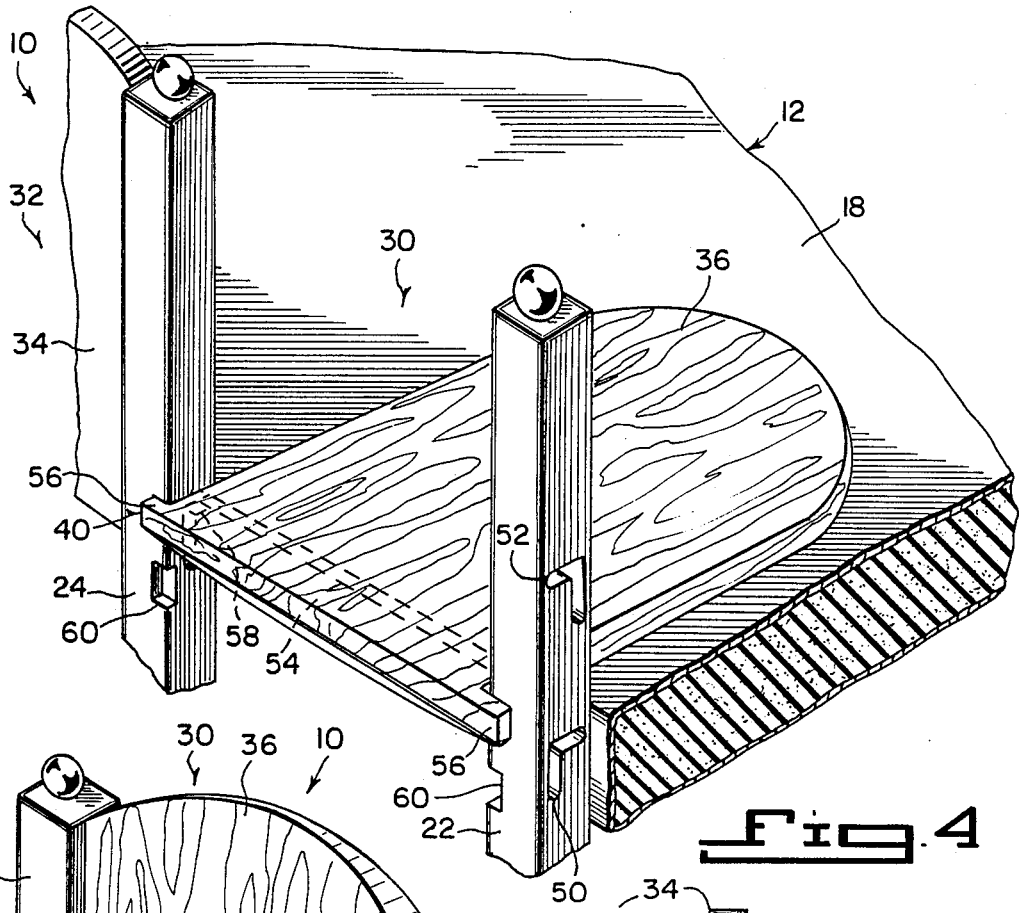
FIG. 4 is an enlarged rear perspective view of the instant invention with parts broken away showing the table panel in a down position on the mattress.
Figure 3:
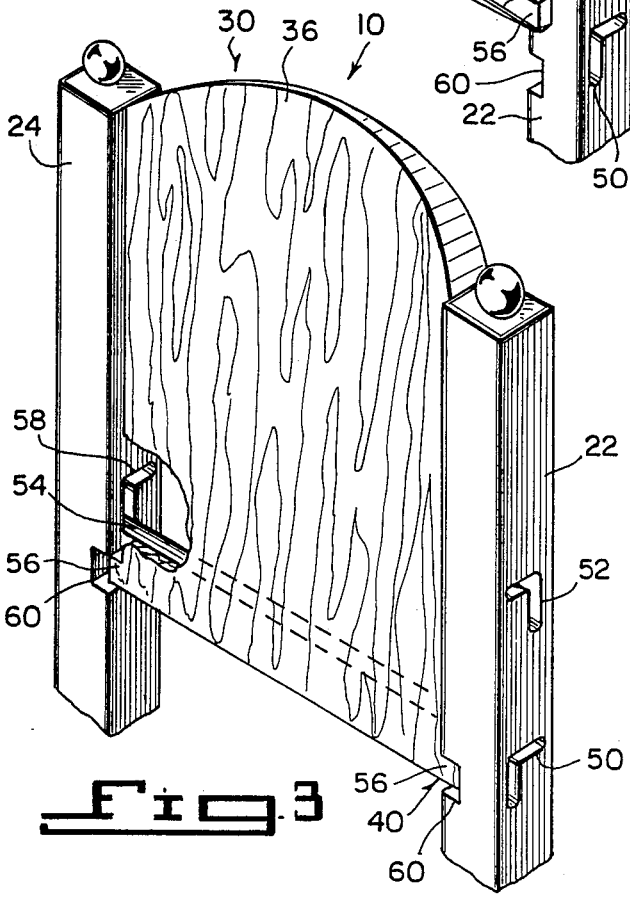
FIG. 3 is an enlarged rear perspective view of the instant invention with parts broken away showing the table panel in an up position.

Turning now descriptively to the drawings, in which similar reference characters denote similar elements throughout the several views, FIGS. 1 through 4 illustrate a combination reclining headboard and table 10 for a bed 12 having a frame 14, box spring 16 and mattress 18. The invention consists of four head posts 20, 22, 24 and 26 spaced apart and secured to the frame 14 at the head, thus dividing it into three sections 28, 30 and 32. A pair of headboard panels 34 are each sized to fit between two of the head posts 20, 22 and 24, 26 at the first section 28 and the third section 32 of the head of the frame 14. A table panel 36 is sized to fit between two of the head posts 22 and 24 at the second section 30 of the head of the frame 14.

A first structure 38 is provided for adjustably moving each of the headboard panels 34 from a vertical position to a rearwardly reclined position between two of the head posts 20, 22 and 24, 26 at the first section 28 and the third section 32 of the head of the frame 14 so that a person (not shown) on the mattress 18 can rest against one of the headboard panels 34 when it is placed in the rearwardly reclined position.

A second structure 40 is provided for adjustably moving the table panel 36 from a vertical position to a forward horizontal position over the mattress 18, between two of the head posts 22 and 24 at the second section 30 of the head of the frame 14 so that a person can place various items on the table panel 36, such as food, reading material, tissues, etc.

Padded material 42 is secured to the front surface of the headboard panels 34 and the table panel 36 to add comfort and beauty thereto. A plurality of buttons 44 help secure the padded material 42 to the front surface of the headboard panels 34 and the table panel 36. Each headboard panel 34 is held in the rearwardly reclined position at approximately forty degrees from the vertical position.

The first structure 38 includes a first rod 46 extending from side to side through the lower portion of the headboard panel 34. A second rod 48 extends from side to side through the middle portion of the headboard panel 34. The two head posts 20, 22 and 24, 26 each have a forwardly facing bayonet slot 50 and a rearwardly facing bayonet slot 52 spaced above the forwardly facing bayonet slot 50 so that the first and second rods 46 and 48 can ride within the forwardly facing bayonet slots 50 and the rearwardly facing bayonet slots 52 to adjustably move the headboard panel 34 from the vertical position to the rearwardly reclined position and vice versa.

The second structure 40 includes a shaft 54 extending from side to side through the lower portion of the table panel 36. The table panel 36 has a pair of fingers 56, each extending outwardly from the bottom side below the shaft 54. The two head posts 22 and 24, each have a forwardly facing bayonet slot 58 and a rear corner notch 60 so that the shaft 54 can ride within the forwardly facing bayonet slots 58 to adjustably move the table panel 36 from the vertical position with the fingers 56 in the corner notches 60 to the forward horizontal position with the fingers 56 in engagement with the backs of the two head posts 22 and 24.

Figure 5:
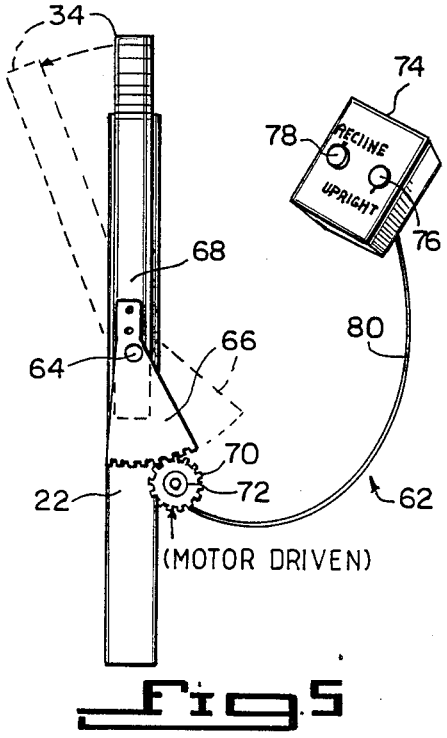
FIG. 5 is a side view of one of the headboard panels adjustably positioned by an electric motor gear drive.

FIG. 5 shows an automatic adjustable moving device 62 for each head panel 34. The device 62 includes a shaft 64 extending from side to side through the lower portion of the headboard panel 34 into the two head posts 20 and 22 therebetween. A gear member 66 is affixed to one side edge 68 of the headboard panel 34. A drive gear 70 is engagable with the gear member 66, while an electric motor 72 is connected to the drive gear 70. A control box 74 having a pair of switches 76 and 78 is electrically connected via an elongated cord 80 to the electric motor 72. A person (not shown) can operate one of the switches 76 to place the headboard panel 34 in the vertical position and then operate other switch 78 to place the headboard panel 34 in the rearwardly reclined position.

LIST OF REFERENCE NUMBERS

10 combination reclining headboard and table
12 bed
14 frame of 12
16 box spring of 12
18 mattress of 12
20 first head post
22 second head post
24 third head post
26 fourth head post
28 first section
30 second section
32 third section
34 headboard panel
36 table panel
38 first structure
40 second structure
42 padded material
44 button on 42
46 first rod in 34
48 second rod in 34
50 forwardly facing bayonet slot
52 rearwardly facing bayonet slot
54 shaft in 36
56 finger on 36
58 forwardly facing bayonet slot
60 corner notch
62 automatic adjustable moving device
64 shaft of 62
66 gear member
68 side edge of 34
70 drive gear
72 electric motor
74 control box
76 first switch in 72
78 second switch in 72
80 elongated cord It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A combination reclining headboard and table for a bed having a frame, box spring and mattress comprising:

(a) four head posts, spaced apart and secured to the frame at the head, thus dividing it into three sections;

(b) a pair of headboard panels, each sized to fit between two of said head posts at the first and third sections of the head of the frame;

(c) a table panel sized to fit between two of said head posts at the second section of the head of the frame;

(d) means for adjustably moving each of said headboard panels from a vertical position to a rearwardly reclined position between two of said head posts at the first and third sections of the head of the frame so that a person on the mattress can rest against one of said headboard panels when it is placed in the rearwardly reclined position; and (e) means for adjustably moving said table panel from a vertical position to a forward horizontal position over the mattress between two of said head posts at the second section of the head of the frame so that a person can place various items on said table panel.

2. A combination reclining headboard and table for a bed as recited in claim 1, further including padded material secured to the front surface of said headboard panels and said table panel to add comfort and beauty thereto.

3. A combination reclining headboard and table for a bed as recited in claim 2, wherein said padded material further includes a plurality of buttons to help secure said padded material to the front surface of said headboard panels and said table panel.

4. A combination reclining headboard and table for a bed as recited in claim 3, wherein each said headboard panel is held in the rearwardly reclined position at approximately forty degrees from the vertical position.

5. A combination reclining headboard and table for a bed as recited in claim 4, wherein said adjustably moving means for each said headboard panel includes:

(a) a first rod extending from side to side through the lower portion of said headboard panel;

(b) a second rod extending from side to side through the middle portion of said headboard panel;

(c) said two head posts each having a forwardly facing bayonet slot and a rearwardly facing bayonet slot spaced above said forwardly facing bayonet slot so that said first and said second rods can ride within said forwardly facing bayonet slots and said rearwardly facing bayonet slots to adjustably move said headboard panel from the vertical position to the rearwardly reclined position and vice versa.

6. A combination reclining headboard and table for a bed as recited in claim 5, wherein said adjustably moving means for said table panel includes:

(a) a shaft extending from side to side through the lower portion of said table panel;

(b) said table panel having a pair of fingers, each extending outwardly from the bottom side below said shaft; and (c) said two head posts each having a forwardly facing bayonet slot and a rear corner notch so that said shaft can ride within said forwardly facing bayonet slots to adjustably move said table panel from the vertical position with said fingers in said corner notches to the forward horizontal position with said fingers in engagement with the backs of said two head posts.

7. A combination reclining headboard and table for a bed as recited in claim 4, wherein said adjustably moving means for each said headboard panel includes:

(a) a shaft extending from side to side through the lower portion of said headboard panel into said two head posts therebetween;

(b) a gear member affixed to one side edge of said headboard panel;

(c) a drive gear engagable with said gear member;

(d) an electric motor connected to said drive gear; and (e) a control box having a pair of switches electrically connected to said electric motor so that a person can operate one of said switches to place said headboard panel in the vertical position and then operate other of said switches to place said headboard panel in the rearwardly reclined position.

* * * * *